United States Patent [19]

Sykes

[11] 4,311,551

[45] Jan. 19, 1982

[54] COMPOSITION AND METHOD FOR ETCHING COPPER SUBSTRATES

[75] Inventor: Donald J. Sykes, Upper Saddle River, N.J.

[73] Assignee: Philip A. Hunt Chemical Corp., Palisades Park, N.J.

[21] Appl. No.: 169,146

[22] Filed: Jul. 15, 1980

Related U.S. Application Data

[63] Continuation-in-part of Ser. No. 29,218, Apr. 12, 1979, abandoned, which is a continuation-in-part of Ser. No. 914,392, Jun. 12, 1978, abandoned.

[51] Int. Cl.[3] ..... C23F 1/02; C03C 15/00; C03C 25/06; B44F 1/22

[52] U.S. Cl. ..... 156/640; 156/659.1; 156/666; 156/902; 252/79.5

[58] Field of Search ..... 252/79.5, 79.1, 156; 156/640, 642, 656, 659.1, 661, 666, 901, 902, 905; 134/3, 41

[56] References Cited

U.S. PATENT DOCUMENTS

| | | | |
|---|---|---|---|
| 3,033,725 | 5/1962 | Daugherty et al. | 156/666 X |
| 3,161,552 | 12/1964 | Bradley et al. | 156/666 X |
| 3,287,191 | 11/1966 | Borth | 156/666 X |
| 3,753,818 | 8/1973 | Poor et al. | 252/79.5 X |
| 3,809,588 | 5/1974 | Zeblisky | 252/79.5 X |

*Primary Examiner*—William A. Powell

*Attorney, Agent, or Firm*—Kirschstein, Kirschstein, Ottinger & Cobrin

[57] ABSTRACT

An alkaline copper etching working bath for dissolving copper containing an etch accelerating additive selected from the group consisting of cyanamide and its precursors. The accelerating additives when added to the alkaline copper etching bath increase the etch rate and reduce undercut. The bath includes cupric ions, an ammonium salt such as a chloride and/or a carbonate, ammonium hydroxide to achieve a pH greater than 7, water, and the etch accelerating additive. The invention includes etching baths, methods for their use, the preparation of a certain etch accelerating additive and the provision of certain cyanamide precursors.

28 Claims, 2 Drawing Figures

INCREASE IN ETCH RATE (ΔR) VS. g/l CYANAMIDE

INCREASE IN ETCH RATE (ΔR) VS. g/ℓ FORMAMADINE DISULFIDE

COMPOSITION AND METHOD FOR ETCHING COPPER SUBSTRATES

RELATED APPLICATIONS

This application is a continuation-in-part of U.S. patent application Ser. No. 029,218 filed Apr. 12, 1979 which is a CIP of application Ser. No. 914,392 filed June 12, 1978, both now abandoned.

BACKGROUND OF THE INVENTION

1. Field of the Invention

This invention relates to etching of copper and, more particularly, to new and improved alkaline copper etching working baths and a process for dissolving copper, wherein the etch rate is increased while etching of the side walls of the copper substrate is retarded.

2. Description of the Prior Art

In the manufacture of printed circuit board laminates comprised of a phenolic or epoxy-glass core, metallic copper is typically laminated to one or both sides of the core. A circuit is made by using an etch-resist pattern to render the appropriate parts of the copper on the board resistant to etching so that when the entire board is contacted with an etching bath all the copper except that required for the circuit is dissolved away. The etch-resist pattern is so named because of its resistance to attack by the etching bath.

In the prior art practice, the copper-clad insulating board bearing the etch-resist pattern was contacted with an acidic ferric chloride or an alkaline ammoniacal cupric chloride etching solution. This was done either by immersing the board and the resist affixed thereto in the etching solution or the etching solution was so applied that droplets impinged in principally perpendicular directions against the copper surface and the resist. The acidic ferric chloride or alkaline ammoniacal cupric chloride etching solution attacked the copper where the metal surface was not protected by the resist and, by chemical action, removed the copper. The copper surface protected by the resist was not subject to a direct attack by the etching solution. As the etching proceeded, the resist-covered portions of the copper stood out in vertical relief. As the depth of the etch increased, the sides of the copper supporting the resist were exposed to the etching solution. The acidic ferric chloride or alkaline ammoniacal cupric chloride etching solution then attacked the exposed metal side walls and undercut the resist around its edges. If not skillfully controlled, this undercutting resulted in circuit lines that were not true representations of the etch-resist pattern transferred to the copper; the circuit lines became narrowed, exhibited lower conductivity, and, upon occasion, the edges of the lines broke off and created short circuits.

In general, where the etch rate is increased, undercutting of the side walls correspondingly is increased. This has discouraged accelerated etching of copper circuit boards. Attempts to control undercutting of the side walls while maintaining the etch rate with aqueous alkaline ammoniacal etchants have heretofore been commercially unacceptable.

SUMMARY OF THE INVENTION

1. Objects of the Invention

It is an object of the present invention to increase the etch rate of copper circuit board substrates by employing an alkaline ammoniacal cupric etching-bath containing a novel etch-accelerating additive.

Another object of this invention is to provide an etch-accelerating additive which not only increases the rate of etching of a copper circuit board substrate when the additive is added to an aqueous alkaline ammoniacal etching bath, but also does not increase the rate of undercutting of the side walls of the copper circuit board laminate overlain by the resist.

A further object of this invention is to provide an etching solution capable of more rapidly etching away unwanted copper and to prepare printed circuit boards with minimum undercutting of the circuit lines or pattern.

Still another object of this invention is to provide a new and improved process for dissolving or etching away the copper substrate of a copper circuit board.

Another object of this invention is to provide new etching solutions especially adapted for use in selectively etching printed copper circuit boards.

These and other objects and advantages of the present invention will become evident from the description which follows.

BRIEF DESCRIPTION OF THE DRAWINGS

The invention will be described in conjunction with the drawings in which.

BRIEF DESCRIPTION OF THE INVENTION

Figure 1:
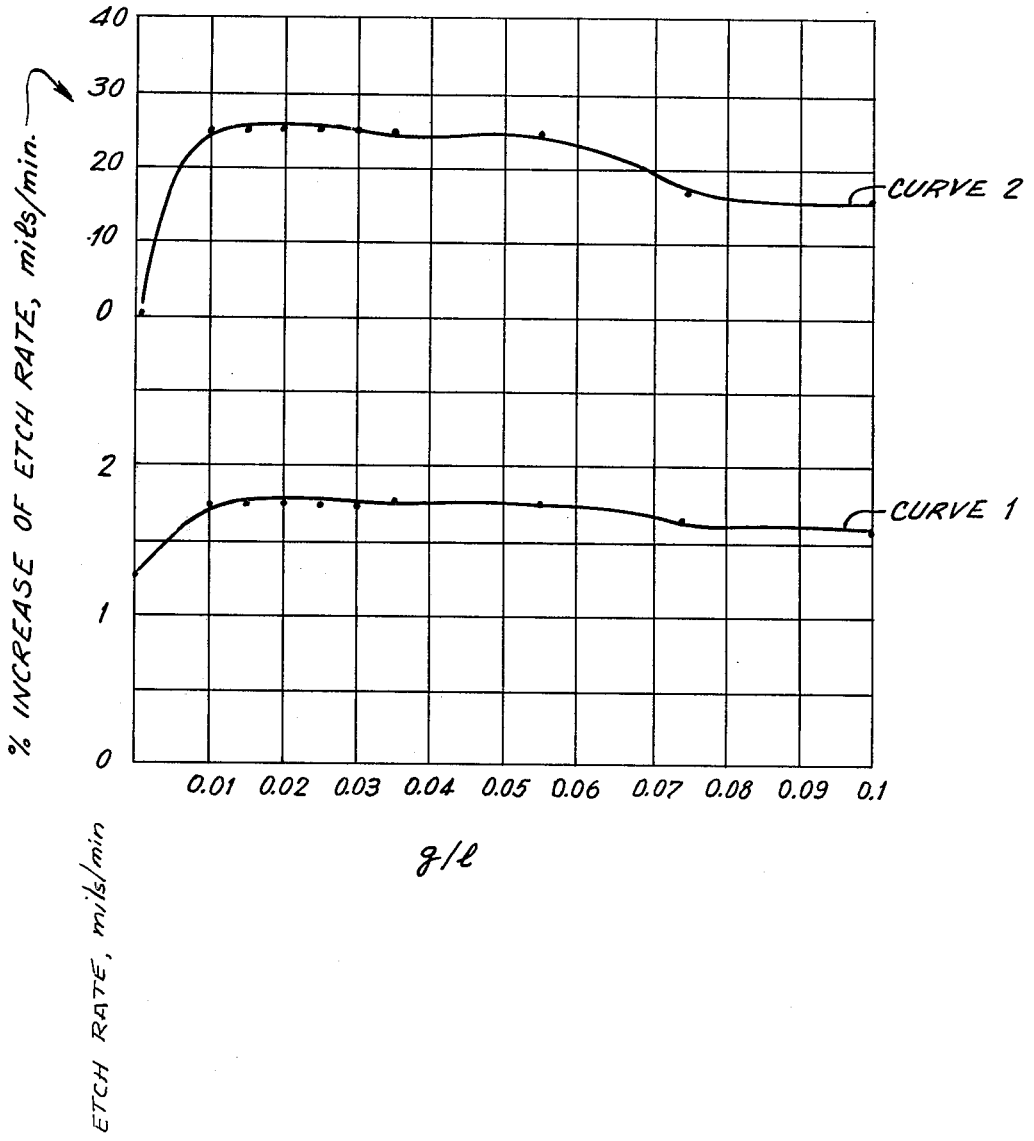
FIG. 1 (Curve 1) shows the etch-rate (R) in mil/min obtained with various concentrations of cyanamide added to a standard etch-bath. Curve 2 of FIG. 1 shows the percent change in etch-rate over the standard bath obtained with various concentrations. This figure relates to Example 3 of table III.

In accordance with the present invention, a high-speed alkaline etching bath is employed to rapidly etch or dissolve metallic copper. Employing the accelerated alkaline etching bath of the present invention, it has been discovered that the etching-rate of the bath can be increased more than about 10% beyond that previously obtainable with the state of the art technology by the addition thereto of certain etch-accelerating additives.

The etch-accelerating additive of this invention is selected from the group consisting of cyanamide and its precursors in alkaline aqueous media. Cyanamide, if used, is added to the aqueous alkaline ammoniacal etching baths conventionally used in an amount between about 0.005 and about 0.3 g/l of the etching bath. The cyanamide precursors, if used, are added in amounts to supply the activity equivalent of cyanamide to the alkaline ammoniacal bath.

This invention specifically relates to the discovery that standard aqueous alkaline ammoniacal cupric etching-baths for copper circuit boards can be improved by the addition of the previously mentioned etch-accelerating additives thereto in the amounts specified. Typical of a standard aqueous alkaline ammoniacal cupric etching-bath formulation is that described in U.S. Pat. No. 3,705,061. Such a bath includes cupric ions, an ammonium salt such as a chloride, ammonium hydroxide to achieve a pH between about 8 and about 10.5, water and, if desired, some ammonium phosphate whose purpose is to prevent the darkening of any conventional solders which may be present on the copper substrate being etched.

Pursuant to the present invention, thiourea or any other cyanamide precursor, e.g. formamidine disulfide and its acid solution salts, diethyl cyanamide, formamidine sulfinic acid, 2,5-dithiobiurea and mixtures thereof may be used as the additive, or the precursors may be combined with (or used in addition to) the cyanamide in an amount sufficient to provide preferably between 0.01 and about 0.2 gram/liter equivalent of cyanamide per liter. The addition of these etch-accelerating additives in such amounts increases the rate of etching by more than ten percent over the etching rate achieved with the same bath without the etch-accelerating additive.

Moreover, it has been further discovered that the addition of the etch-accelerating additive of the present invention to a standard aqueous alkaline ammoniacal cupric etching bath also provides side wall protection during etching. Although the mechanism by which the etch rate is increased without a concurrent increase in side wall undercutting is not fully understood, the following is believed to occur:

The presence of the etch-accelerating additive causes the formation of a physically weak etch-resistant film on the copper substrate. This etch-resistant film on the side walls of an etched depression serves to protect said side walls and thereby to diminish undercutting. Said etch-resistant film is broken at the bottom of the depression during the spray etching operation by controlling the direction at which droplets of the etching bath impinge on the bottom. By constantly breaking and reforming the etch-resistant film at the bottoms of the etched areas, it is possible to obtain unique directional etching normal to the surface of the copper substrate. The film is strong enough to substantially resist breaking when struck at acute angles, so that the films on the side walls tend to remain unbroken so as to retard or prevent substantial etching of the side walls in a direction lateral to the surface of the copper substrate.

It also is believed that the etch-resistant film contains cupric ions which oxidize and solubilize the metallic copper with which they come into contact. However, such dissolution stops after the cupric ions are depleted. Consequently, if the etch-resistant film were deposited on all of the exposed copper, etching would essentially halt in a quiescent bath of the aqueous alkaline ammoniacal cupric etching formulation of this invention. However, the formation of the etch-resistant film at the bottoms of the etched areas can be disrupted and hence removed therefrom without substantially affecting the retention of the etch-resistant film on the side walls of the etched area. This disruption may be accomplished by brushing, by splashing, or by forced flow of the etching bath against the copper as etching proceeds. The disruption of the etch-resistant film allows the metallic copper substrate, thus constantly freshly exposed, to be contacted by fresh cupric etching bath. Thus, where the etch-resistant film is disrupted or broken up, etching of the copper substrate now unprotected by the film can continue; but where said film perseveres, unbroken or less frequently broken, etching is retarded.

The employment of the etch-accelerating additive of the present invention in combination with an otherwise standard aqueous alkaline ammoniacal cupric etching bath has resulted in an etching bath with an increased etch factor over that obtainable by using the standard aqueous alkaline ammoniacal cupric etching bath without the etch-accelerating additive.

By "etch factor" is meant the ratio of the depth of the etch adjacent to a line of resist, to a side etch measured at the top of the surface of the substrate to the line of resist. The etch factor is a means of evaluating the unidirectional characteristics of etching solutions. The higher the etch factor, the more effective is the downward etching relative to the lateral etching.

DETAILED DESCRIPTION OF THE INVENTION

According to the present invention, it is preferred that the etching bath with the etch-accelerating additive be sprayed onto the copper substrate to be etched; but other procedures for directing impinging streams or droplets onto the substrate may be used.

The typical spray etcher that may be used in the present invention comprises a plastic etching chamber and a plastic conveyor, e.g. helical rollers, to move the substrate such as printed circuit boards or work pieces through the etcher and into a rinse chamber and then out of the rinse chamber. Provision also is made for the conveyor to move the work pieces through the etching chamber at various speeds as well as to pump the etching bath from the etching chamber through numerous spray heads thereby causing droplets of the etching bath to forcefully impinge substantially perpendicularly upon the work piece or the printed circuitboard surface. An example of a suitable etcher is the DEA 120 spray etcher (commercially available from DEA Products, Inc., Tempe, Ariz.).

When a spray etching system is employed, the etching bath of the present invention contacts the copper substrate in the following manner:

The etching bath, in the form of streams of droplets travels a course substantially perpendicular to the target copper substrate and, upon striking the target copper substrate, breaks any etch-resistant film which was formed after impingement of previous droplets. The droplets, of course, also strike the side walls, but the angle of incidence with the side walls is such that the protective film on the side walls does not tend to break.

Further, the etching bath also strikes the resist. This however, is without significance since the resist is not affected by impingement of the droplets of the etching bath.

An alternative to the spray process is to use paddles that throw droplets off the paddle tips directed onto the target area.

As previously mentioned, according to one aspect of this invention, cyanamide is added to an aqueous alkaline ammoniacal cupric etching bath. When cyanamide is added, it is believed to form an adduct or complex with the copper ions, possibly with the cupric-ammonium ions of the bath and provides the beneficial and advantageous effects of this invention immediately. However cyanamide ($H_2NCN$) is a toxic irritant requiring careful handling. Further, cyanamide is noted for its tendency to dimerize to dicyandiamide or cyanoguanidine, $NH_2C(:NH)(NHCN)$, particularly at elevated pH levels. It has been noted that this dimer of cyanamide is not an etch-accelerant useful in the present invention.

Apparently the dimerization reaction is not reversible under the alkaline conditions present in the etching baths. The use of cyanamide as the additive in alkaline etchant baths prepared in advance of use causes competition between the reactions forming the postulated accelerant adduct and those forming the inactive dimer. For this reason as well the toxic considerations it is preferred, as a part of good manufacturing practice, to use certain of the less toxic cyanamide precursors and suitable additives prepared therefrom, instead of cyanamide itself. However, it should be noted that cyanamide, in the form of its commercially available stabilized 50% aqueous solution, may be used as the etch-accelerating additive for the purposes of this invention.

When certain cyanamide precursors which form cyanamide in situ in alkaline solutions, e.g. thiourea, are added to the bath, an etch-acclerating effect is often not immediately obtained; such an effect, however, is noted within about two to 24 hours after the addition of these compounds or agents made therefrom to the baths. From the above it is believed that an involved series of reactions occur leading to the formation of the cyanamide and the subsequent adduct of the resulting cyanamide with the copper ions and/or the cupric ammonium ions of the bath to provide the useful etch acceleration effects of this invention.

When thiourea is added to an aqueous, alkaline, ammoniacal, cupric etching bath, the rate of etching of the etching bath initially decreases, but this addition starts a reaction, which is not well understood, but which has been found to result, after a period of at least two to four hours preferably about 24 hours, in the presence of copper ions yielding the bath having a higher etching rate than is obtained without the addition of the thiourea. The formamidine disulfide dihydrochloride or the diethyl cyanamide or formamidine sulfinic acid or the 2,5-dithiobiurea show their etch-accelerating activity almost immediately.

In general, the increases in the rate of etching obtained with either cyanamide or its precursors are between about 10 percent and about 40 percent over the conventional bath. Usually increased etch rates within the preferred range of concentrations are about 20 to 30 percent.

It has been found that when thiourea is added to a standard aqueous alkaline ammoniacal cupric etching bath the bath so obtained is most effective in increasing etch rate of the copper substrates 24 to 48 hours after thiourea has been added. The etch-accelerating additive formed by addition of thiourea to copper is preferably prepared in advance and then this preformed additive is added to the working bath whereupon the bath is effective immediately to accelerate etch rate. The formation of this etch-accelerating additive will be described in greater detail below.

The etching bath of the present invention has its various parameters adjusted to obtain commercially acceptable etching in a manner well known to the art. These parameters include the temperature of the etchant, the spray pressure at which the pumps furnish etchant to the nozzles for impingement on the copper substrate, the manner of contacting the copper substrate with the etching bath as referred to previously herein, and, of course, the concentration of the standard ingredients of the aqueous alkaline ammoniacal cupric etching-bath. All of these factors are selected for desired optimum etching conditions as standardized in the art. The only additional and non-conventional parameter for the practice of this invention is the concentration of the etch-accelerating additive to form the novel baths of this invention.

As previously mentioned, cyanamide should be added to the standard aqueous alkaline ammoniacal cupric etching bath in an amount between about 0.005 and about 0.3 g/l. The precursors should be used in equivalent amounts to provide the activity shown by cyanamide.

Preferably cyanamide is added in an amount between 0.01 and about 0.1 g/l to the etching bath. The prepared thiourea additive, if used, is added to the standard aqueous alkaline ammoniacal cupric etching bath in cyanamide activity equivalent amounts. The resultant solution of the thiourea reaction product is standardized in relation to the amount of cyanamide accelerating activity it exhibits. Generally for convenience this thiourea-copper reaction product additive is supplied in the form of a liquid solution of the additive prepared as will be described below.

Excessive amounts of the etch-accelerating additives of this invention are not desirable since beyond a certain concentration they decrease the acceleration rate. However, in the range of 0.2 to 0.5 g/l there is a substantial plateau of acceleration. It is only beyond the levels of the etch-accelerating concentration plateau that a significant decrease in etching rate is noted.

On the other hand if insufficient etch-accelerating additive is added to the etching bath, the increase in the etch rate is not commercially significant i.e. below 10 percent rate increase. This lower limit has been found to be about 0.005 g/l for cyanamide and cyanamide-activity-equivalent amounts for the various cyanamide precursors.

The standard conventional aqueous alkaline ammoniacal cupric etching bath to which the accelerating agent is added pursuant to the present invention can vary as to its constituents. The following etching bath is illustrative of the ranges of ingredients of a suitable bath composition for use with the addition of accelerating agents of the present invention:

TABLE I

| Working Bath | Moles/Liter |
|---|---|
| Cupric ions as metallic copper | 1.0–2.8 |
| Ammonium chloride | 2.2–6.2 |
| Ammonium hydroxide | 2.0–9.0 |
| Ammonium phosphate-monobasic, NH4H2PO4 | 0.001–0.10 |
| Water q.s. to | 1 liter |
| pH | 8.0–9.0 |

The cupric ions are supplied in the etching solution of this invention by cupric salts such as cupric chloride, cupric nitrate, cupric acetate, cupric carbonate, cupric ammonium sulfate and the like; cupric chloride is employed as an example.

The standard aqueous alkaline ammoniacal cupric etching bath suitable for use in the practice of the present invention contains as the oxidizing complex, cupric ions in the form of a complex salt having the general formula $$Cu^{++}(Y)_x(Z^-)_n$$

wherein Y is the complexing agent; Z is the anion of the complex salt, n represents the mol ratio of anion to cupric ion and x represents the mol ratio of complexing agent which complexes with the cupric ion. The complexing agent employed may be either the ammonia or a mixture of the ammonia and one or more chelating agents which will provide a bivalent cupric complex in the alkaline media.

Illustrative but in no wise limiting of the chelating agents for complexing cupric ions in conjunction with ammonia, there may be mentioned ethylenediamine tetraacetic acid, ethylenediamine, diethylenetriamine, triethylenetetraamine, $\beta,\beta',\beta''$ tri(aminoethyl)amine and the like. The preferred chelating agents are those which have tetra or hexadentate properties and ethylenediamine tetraacetic acid is particularly preferred.

As the alkaline etching bath is used to dissolve copper, the resulting oxidized metallic copper and reduced cupric ions cause a buildup of cuprous ions. These must be oxidized back to the cupric state and because of the attendant loss of chemicals due to the continuous carry out of a portion of the etching bath from the system with etched work pieces proper balance should be maintained. A replenisher solution is employed to control the pH range of the system, to make up for the withdrawn complexing agents for the copper and other ingredients and to dilute the copper concentration to an optimum level. Accordingly, the replenisher solution contains ammonium hydroxide for pH control and ammonium salts and/or chelating agents to complex with copper. No fresh copper ions are needed since two cuprous ions enter into the solution for each cupric ion reduced.

Among the useful ammonium salts which may be employed, there may be mentioned ammonium carbonate, ammonium carbamate, ammonium sulfate, ammonium chloride, ammonium acetate, ammonium fluoride, ammonium phosphate and the like, as well as mixtures thereof. The preferred ammonium-based replenishing solution is one containing ammonium hydroxide and ammonium chloride and phosphates.

For the specific alkaline etching bath described above, the preferred replenisher solution has a specific gravity of about 1.0 and is added in amounts to maintain the etching bath at a pH above about 8.0, preferably between about 8.0 and about 9.0, optionally between about 8.3 and 8.5.

While the copper content of the alkaline etching baths of this invention may be varied widely, the preferred baths contain on the average from about 50 to about 200 or somewhat more grams of copper per liter, preferably from about 100 grams or less to about 200 grams or somewhat more per liter.

The temperature of the etching bath of this invention during the dissolution and etching of metallic copper can be room temperature or elevated temperatures up to about 135° F. The etching rate increases with increasing solution temperature. Temperatures of the etching solution much above 135° F. should be avoided, due to expulsion of ammonia at such higher temperature. A preferred temperature of operation is about 120° F. A one oz. per square foot copper circuit board (1.4 mils thick) will be effectively etched in approximately sixty seconds in an etching bath of this invention having a temperature of about 120° F. Copper layers of greater thickness would require a greater etching time. The bath also can be used to etch circuit boards which are copper-coated on both sides.

The following preparations and examples illustrate at least one of the best modes presently known for conducting the process of this invention and of etching bath compositions employed therein.

PREPARATION A

Preparation of Etch Accelerating Additive Solution

An etch-accelerating additive solution according to the present invention was prepared according to the following procedure:

Two liquid premix solutions were formulated. The first pre-mix solution contained of 93.23 g/l of thiourea, 0.280 g/l of sodium hydroxide (50% water solution), and 930.79 g/l of deionized water. The second pre-mix solution consisted of 96.41 g/l of copper sulfate pentahydrate and 962.89 g/l of deionized water. The two solutions were mixed in a ratio of two parts by volume of the first solution to one part by volume of the second solution with agitation for about thirty minutes at a temperature at or below 20° C. 44.24 g/l of a precipitate consisting of a cuprous thiourea additive compound and 2–3 moles of thiourea per mol of cuprous copper was recovered by filtration. The filtrate was discarded. At ambient temperature and pressure a liquid slurry of the precipitate was prepared by mixing for about 30 minutes 869.73 g/l of deionized water and 180.80 g/l of a 50% sodium hydroxide solution with the precipitate. The material (68.919 g/l of the precipitate, based on dry weight), was slurried in the alkaline solution and agitated. (The above weight of deionized water includes that present in the wet precipitate as recovered). The suspended slurry was then refiltered to remove any copper sulfide sludge formed by the reaction of the cuprous sulfate pentahydrate-thiourea compound with sodium hydroxide. About 31.64 g/l of copper sulfide sludge was removed. Remaining in solution in the alkaline solvent was the liberated cyanamide together with some dissolved thiourea and other sulfur compounds. This reaction product recovered in the two-stage reaction as outlined above was a clear filtrate and it constitutes the etch-accelerating additive solution (hereinafter Preparation A) according to this aspect of the invention. The recovered solution is an etch-accelerating additive which will activate and accelerate the etching capabilities of a standard aqueous alkaline ammoniacal cupric etching bath, as discussed above. This additive solution was a liquid having a colorless to light straw appearance and is essentially odorless. It had a specific gravity of 1.087 at 20/4° C. with a pH of 13.5 at 25° C. This solution when added to a standard etching bath in an amount of 5.22 g/l provided an etch-accelerating activity which is equivalent in acceleration effect to 0.063 g/l of cyanamide.

EXAMPLE 1

The etch-accelerating additive solution of Preparation A was employed in the process of the present invention in the following manner:

A thoroughly cleaned DEA 120 spray etcher was charged with 22 gallons of a standard aqueous alkaline ammoniacal cupric etching-bath having the following composition to establish the conditions available according to the prior art processes:

TABLE II

| Starter | Moles/Liter |
|---|---|
| Copper ions as metallic copper | 2.4 |
| Ammonium chloride | 5.4 |
| Ammonium hydroxide | 5.0 |
| Ammonium phosphate | .01 |
| Water q.s. to | 1 liter |

TABLE II-continued

| Starter | Moles/Liter |
|---|---|
| pH | 8.3–8.5 |

Etching conditions employed were: (1) a spray pressure of 15 psi (gauge); and (2) a temperature of 118° F. to 122° F.

The standard rate of etching was established using five ½" square single-side 2 oz. nonresist coated copper-clad laminates. Etch time was measured by observing the time at which etching was complete. The amount of copper removed, about 2.8 mils, divided by this time determined the etch-rate designated as $R_0$. This step was repeated. The etch bath was removed and the machine rinsed with water.

Next, there was added to the sump of the etcher, which was charged with the etch composition of Table II, a quantity of the etch-accelerating additive solution of the present invention in the form of Preparation A. 5.22 g. of this additive solution were added for each liter of the standard aqueous alkaline ammoniacal etching bath described previously in this example. 5.22 g/l of the etching-accelerating additive solution of Preparation A is equivalent in acceleration affect to 0.063 g/l of cyanamide. The spray pump was turned on and allowed to run for at least ten minutes with no work pieces passed therethrough to permit adequate mixing. The etch-rate was determined, again using five ½" square single-side 2 oz. non-resist coated copper-clad laminates in the etching-bath of the present invention containing the etch-accelerating additive solution of Preparation A. The etch rate using the etching-bath of the present invention was designated as $R_1$. The increase in etch-rate was calculated using the following formula:

$$\frac{(R_1 - R_0) \times 100}{R_1} = \% \text{ Increase}$$

The average etch-rate, $R_0$, using the standard alkaline ammoniacal etching bath (averaging of three runs) was found to be 0.95 mils/min. The average etch-time for three runs with the standard etching-bath was found to be 169 seconds. When the etching-bath of this invention was employed, the etch-rate, $R_1$, based on averaging three runs was found to be 1.35 mils/min. The average etch-time for the three runs with the etching-bath of this invention was found to be only 119 seconds.

Consequently, a 29.6% increase in R over the prior art etch-rate was measured using the etching-bath described.

EXAMPLE 2

Example 1 was repeated with the following differences:

A DEA 241E spray etcher was employed. The spray pressure (gauge) was 22 psi and the bath temperature was 120° F. The etch rate employing a standard aqueous alkaline ammoniacal cupric etching-bath such as set forth previously herein in Example 1 was found to be $R_0$=1.4 mils/min based upon an average of three runs. 5.2 g/l of the etch-accelerating additive of Preparation A were added to the standard etching-bath of Example 1 to form an etching-bath of this invention. The etch-rate employing this etching-bath of the present invention was found to be $R_1$=2.0 mils/min based upon an average of three runs, a 30% increase in the etch-rate over that achieved with the standard etching-bath of Example 1.

EXAMPLE 3

Various ppm's of cyanamide were added to a standard etching-bath having the formulation described for the standard etching-bath of Example 1. A DEA 120 spray etcher was employed to deliver the etching-bath to 2 oz. copper per square foot substrates, the etching-bath was operated at about 15 psi spray pressure. The pH of the bath was 8.3. The following table summarizes the results obtained.

TABLE III

| Cyanamide | Etch-Rate (R) (mils/min) | R % |
|---|---|---|
| 0 | 1.34 | 0 |
| 0.010 g/l | 1.79 | 25 |
| 0.015 g/l | 1.79 | 25 |
| 0.020 g/l | 1.79 | 25 |
| 0.025 g/l | 1.79 | 25 |
| 0.030 g/l | 1.79 | 25 |
| 0.035 g/l | 1.79 | 25 |
| 0.055 g/l | 1.79 | 25 |
| 0.075 g/l | 1.61 | 17 |
| 0.100 g/l | 1.60 | 16 |
| 0.200 g/l | 1.60 | 16 |

As indicated in Table III above, the etch-rate increased when cyanamide was added to the standard etching bath until a plateau was reached as additional cyanamide was added to the etching bath. The plateau did not fall below 10 percent increase in etch rate until the concentration of cyanamide was about 0.30 g/l. Refer to FIG. 1.

EXAMPLE 4

Example 3 was repeated except that various amounts of the etching-accelerating additive of Preparation A were added to the standard etching-bath of Example 1. The results of these runs are summarized in the following table:

TABLE IV

| Etch Accelerating Additive Solution Of Preparation A | Etch Rate (R) (pH 8.0–8.1) | R % |
|---|---|---|
| 0 | 1.0 mils/min | 0 |
| 2.61 g/l | 1.27 mils/min | 21 |
| 5.22 g/l | 1.43 mils/min | 30 |
| 7.83 g/l | 1.20 mils/min | 17 |

As can be seen from Table IV above, additions of the Preparation A solution to the standard etching-bath resulted in a marked increased in the etch-rate over that achieved using the standard etching-bath without the etch-accelerating additive of the present invention.

EXAMPLE 5

In this example, a DEA 120 spray etcher was employed having a sump capacity of 20 gallons. A control of fresh etching-bath was employed before each set of additions to eliminate any variations due to any residue left from the sump of previous additions or change in etch-rate due to day-to-day laboratory conditions. After completion of each test, the sump was drained and thoroughly cleaned with warm tap water. The standard etching-bath of Example 1 was employed as the comparison etching-bath throughout this example. All tests were performed at an operating temperature of 120° F. The additive and comparison compounds were added as powders directly into the etch-bath in the sump. The spray etcher was turned on and allowed to run without etching for ten minutes after each addition to insure complete mixing.

The test samples employed were one-sided 2 oz. non-resist coated copper-clad laminates cut into six inch squares. The procedure employed was as follows:

The sump was charged with the fresh standard etching-bath of Example 1 and allowed to reach 120° F. operating temperature. Next, the test substrates were etched until only a slight haze of copper remained. This was repeated to insure that the exact break through time was achieved. This was recorded. Then, preselected additions of various ingredients, some of which were not accelerative, were made and allowed to mix into the etching bath. Then, fresh test substrates were etched again to a slight haze and this part of the test duplicated. The time was recorded. The spray etcher was cleaned prior to each control run. Lastly, the calculation described in Example 1 for measuring the increase in etch-rate was employed.

Runs 1, 5, 9, 13 and 16 were control runs employing fresh standard etching bath. The results of Runs 2–4 were compared with the results of Run 1; the results of Runs 6–8 were compared with the results of Run 5; the results of Runs 10–12 were compared with the results of Run 9; the results of Runs 14–15 were compared with the results of Run 13; and the results of Run 17 were compared with the results of Run 16. The additional ingredients for the succeeding runs following each control run were additive.

The results of this example are summarized in the following table:

TABLE V

| Run No. | Etching Bath | pH | Etch-Time to break through | % Etch-Rate Increase Over Control ΔR % | Etch-Rate mil/min R | Comment |
|---|---|---|---|---|---|---|
| 1 | Standard etching bath (SEB) | 8.3 | 160 secs. | — | 1.05 | Normal |
| 2 | No. 1 bath plus 0.067 g/l cyanamide | 8.3 | 122 secs. | 23.9 | 1.38 | — |
| 3 | No. 2 bath plus 0.096 g/l thiourea | 8.4 | 127 secs. | 20.5 | 1.32 | Thiourea freshly |
| 4 | No. 3 bath plus 0.067 g/l cyanoguanidine | 8.4 | 127 secs. | 20.5 | 1.32 | Thiourea unreacted |
| 5 | Standard Etching bath (SEB) | 8.45 | 168 secs. | — | 1.0 | Normal |
| 6 | No. 5 bath plus 0.067 g/l cyanoguanidine | 8.32 | 178 secs. | −6.4 | 0.94 | — |
| 7 | No. 6 bath plus 0.067 g/l Cyanamide | 8.30 | 127 secs. | 24.2 | 1.32 | — |
| 8 | No. 6 bath plus 0.067 g/l Cyanamide | 8.40 | 112 secs. | 33.3 | 1.5 | — |
| 9 | Standard etching bath (SEB) | 8.45 | 178 secs. | — | 0.94 | Very slow |
| 10 | No. 9 bath plus 0.067 g/l cyanamide | 8.45 | 112 secs. | 37.3 | 1.5 | |
| 11 | No. 10 bath | 8.45 | 108 secs. | 39.7 | 1.56 | After 2 hours |
| 12 | No. 10 bath | 8.5* | 127 secs. | 28.8 | 1.32 | After 72 hr |
| 13 | Standard etching Bath (SEB) | 8.45 | 178 secs. | — | 0.94 | Very slow |
| 14 | No. 13 bath plus 0.096 g/l Thiourea plus 0.067 g/l cyanamide | 8.45 | 127 secs. | 28.8 | 1.32 | Thiourea unreacted |
| 15 | No. 14 bath | 8.50* | 122 secs. | 31.9 | 1.38 | After 2 hr |
| 16 | standard etching Bath (SEB) | 8.45 | 160 secs. | — | 1.05 | Normal |
| 17 | No. 16 bath plus 0.067 g/l guanidine | 8.45 | 152 secs. | 5.4 | 1.11 | |

*pH adjusted by additional ammonium hydroxide

As can be seen from Table V, the presence of cyanamide in Runs 2, 3, 4, 7, 8, 10–12, 14 and 15 resulted in increased etch-rates over the control runs.

Even after remaining in the sump of the spray etcher for 72 hours, the etch rate using the etching bath containing cyanamide still showed an increase of 28.6% over the etch rate employing the control standard etching bath. This slight drop in etch-rate after a period of time was less than expected. The compounds in the etching bath reacted with copper and were expected to degrade.

It is also noted that the addition of guanidine in run No. 17 did not produce an appreciable increase in the etch rate.

It is noted that cyanoguanidine (dicyandiamide), the dimer of cyanamide, apparently inhibited the etch-rate of the standard bath (Run 6).

EXAMPLE 6

Utilizing the procedure described in Example 3 but substituting diformamidine disulfide dihydrochloride (also known as formamidine disulfide dihydrochloride or FDD for the cyanamide the etch-rates noted in Table VI were obtained.

TABLE VI

| | Bath | pH 8.2–8.4 Etch-Rate (R) (mils/min) | R % |
|---|---|---|---|
| 1 | SEB | 1.42 | |
| 2 | No. 1 bath plus 0.01 g/l FDD | 1.85 | 23.0 |
| 3 | No. 1 bath plus 0.025 g/l FDD | 1.94 | 27.0 |
| 4 | No. 1 bath plus 0.05 g/l FDD | 2.04 | 31.0 |
| 5 | No. 1 bath plus 0.075 g/l FDD | 2.04 | 31.0 |
| 6 | No. 1 bath plus 0.125 g/l FDD | 2.04 | 31.0 |
| 7 | No. 1 bath plus 0.175 g/l FDD | 1.94 | 27.0 |
| 8 | No. 1 bath plus 0.225 g/l FDD | 1.87 | 24.0 |

The plateaus observed in Example 3 with cyanamide were also noted here. The concentration of the formamidine disulfide dihydrochloride which showed an etch-rate increase of 10 percent was about 0.40 g/l.

Figure 2:
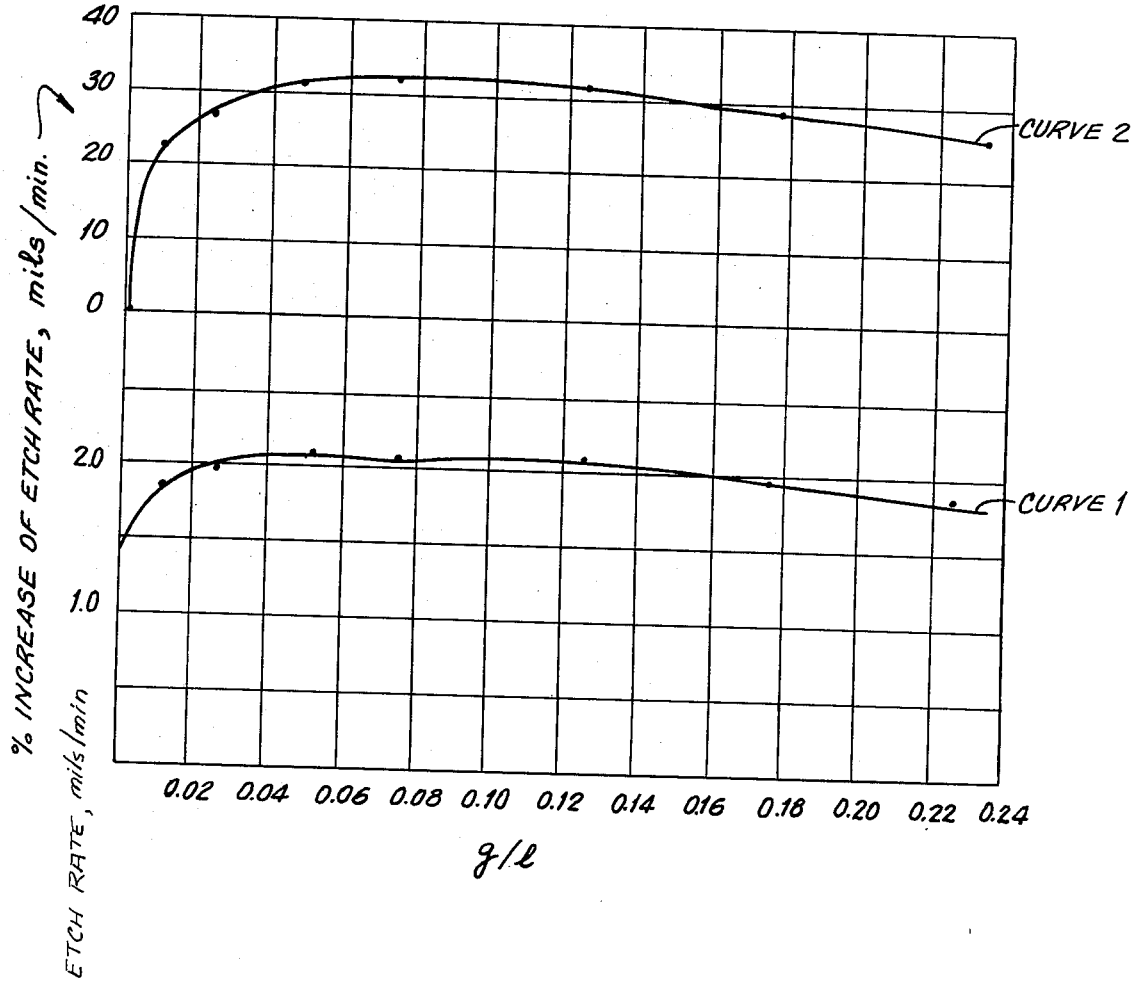
FIG. 2 Curve 1 shows the etch-rate (R) in mil/min obtained with various concentrations of formamidinedisulfide dihydrochloride added to a standard etch bath. Curve 2 of FIG. 2 shows the percent change ($\Delta R\%$) over the standard bath obtained with various concentrations. This figure relates to Example 6 and Table VI.

Curve 2 of FIG. 2 shows the etch-rates of this material.

The formamidine disulfide dihydrochloride has the accepted structural formula of

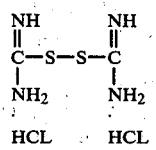

and is considered to be dimer of thiourea. However as an additive of this invention it apparently is converted to an active material in the bath by a route other than through thiourea. Thiourea by way of contrast, as noted earlier, only becomes active as the accelerant additive after the lapse of some time—4 to 48 hours after addition to the bath.

Diethyl cyanamide and other alkyl cyanamides are apparently directly converted to cyanamide to form the active accelerant of the invention by the alkalinity of the etch-bath and the presence of the copper ions. The exact nature of the cyanamide copper adduct which is the accelerant is not apparent from the nature of the precursors but is clearly effective for increasing the etch rate of the baths without the expected substantial increase in undercut expected and obtained in aqueous alkaline etching baths free of said additive and accelerated by etching at higher temperatures.

Although the invention has been illustrated by the preceding examples, it is not to be construed as being limited thereto, but rather the invention is directed to the generic area as hereinbefore disclosed. Various modifications and embodiments may be made without departing from the spirit and scope thereof.

EXAMPLE 7

Additive tested was dithiobiurea.

A preweighed copper ring was immersed in a flask of etchant heated to 120° F. The ring was rotated for 60 seconds, removed, rinsed with water and reweighed. The etching activity was judged by the amount of copper the etchant removed from the ring.

Test chemicals were added to the etchant and the etching tests were repeated to determine the effects on the etching rate.

The results of this example are summarized in the following table:

TABLE VII

| | BATH | Wt. Loss (g/min.) | % Change |
|---|---|---|---|
| 1. | Standard Etching bath of Example 1 (control) | 0.733 | +0 |
| 2. | No. 1 Bath plus 0.05 g/l dithiobiurea | 0.85 | +16 |
| 3. | No. 1 Bath plus 0.10 g/l dithiobiurea | 0.92 | +26 |
| 4. | No. 1 Bath plus 0.20 g/l dithiobiurea | 0.98 | +34 |
| 5. | No. 1 Bath plus 0.40 g/l dithiobiurea | 1.01 | +38 |

Having thus described the invention, there is claimed as new and desired to be secured by Letter Patent:

1. An aqueous alkaline ammoniacal cupric etching spray bath containing an etch accelerating additive selected from the group consisting of cyanamide and its precursors, said etch accelerating additive being present in an amount sufficient to increase the etch rate of said bath by at least about 10 percent over an identical aqueous alkaline copper etching bath free of said additive.

2. A process of etching a copper-clad substrate having a portion of its surface masked with a resistant coating including the step of forcefully contacting both the masked and unmasked portions of said surface with a stream of an aqueous alkaline ammoniacal cupric etching solution containing an etch-accelerating-additive selected from the group consisting of cyanamide and its precursors, said etch-accelerating additive being present in an amount sufficient to increase the etch-rate of said bath by at least about 10 percent over an identical aqueous alkaline copper etching bath free of said additive and without substantially increasing the amount of undercut over the undercut obtained on a copper-clad substrate with an identical aqueous alkaline etching-bath free of said additive.

3. A process of etching a copper-clad substrate having a portion of its surface masked with a resist coating, according to claim 2, including the step of impinging, in a substantially perpendicular direction upon both the masked and unmasked portions of said surface, an aqueous alkaline ammoniacal cupric etching solution containing an etch-accelerating additive selected from the group consisting of cyanamide and its precursors, said etch-acelerating additive being present in an amount sufficient to increase the etch-rate of said bath by at least about 10 percent over an identical aqueous alkaline copper etching bath free of said additive and without substantially increasing the amount of undercut over the undercut obtained on a copper-clad substrate with an identical aqueous alkaline etching-bath free of said additive.

4. The aqueous alkaline ammoniacal cupric etching bath as defined in claim 1 wherein said etch accelerating additive is present in an amount between about 0.005 and about 0.3 g of cyanamide per liter of said bath or in an activity equivalent amount of said cyanamide precursor.

5. The aqueous alkaline ammoniacal cupric etching bath as defined in claim 1 wherein said etch accelerating additive is a cyanamide precursor selected from the group consisting of formamidine disulfide, the acid addition salts of formamidine disulfide, formamidine sulfinic acid, 2,5-dithiobiurea, lower alkyl cyanamides, mixtures thereof and the reaction products of said cyanamide precursors with cupric salts in an alkaline medium.

6. The etch bath according to claim 1 wherein said additive being present in amount between about 0.01 and about 0.2 g/l of cyanamide or in equivalent activity amount of the precursor.

7. The aqueous alkaline ammoniacal cupric etching bath as defined in claim 1 wherein said etch accelerating additive is the accelerating effective portion of the reaction product of thiourea and a cupric salt in alkaline medium, said reaction product being present in said bath in an activity equivalent amount to between 0.005 and 0.3 grams of cyanamide per liter of said bath.

8. The aqueous alkaline ammoniacal cupric etching-bath as defined in claim 1 wherein said etch accelerating additive is cyanamide and said cyanamide is present in an amount between 0.01 and about 0.1 g/l of said bath.

9. The aqueous alkaline ammoniacal cupric etching-bath as defined in claim 1 wherein said etch-accelerating additive is a mixture of cyanamide and thiourea.

10. The aqueous alkaline ammoniacal cupric etching-bath as defined in claim 1 wherein said etch-accelerating additive is formamidine disulfide or its acid addition salts.

11. The aqueous alkaline ammoniacal cupric etching-bath as defined in claim 1 wherein said etch-accelerating additive is 2,5-dithiobiurea.

12. The aqueous alkaline ammoniacal cupric etching-bath as defined in claim 1 wherein the pH of said bath is between about 8 and about 9.

13. The aqueous alkaline ammoniacal cupric etching-bath as defined in claim 1 wherein the temperature of said bath is about 120° F.

14. The aqueous alkaline ammoniacal cupric etching-bath as defined in claim 1 wherein said etch-rate increase is between about 10 percent and about 40 percent of a bath without additive.

15. The process of etching a copper-clad substrate as defined in claim 3 wherein said etch-accelerating additive is cyanamide, said cyanamide being present in an amount between about 0.005 and about 0.3 g/l of said bath.

16. The process of etching a copper-clad substrate as defined in claim 3 wherein said etch-accelerating additive is a cyanamide precursor present in said bath in an activity equivalent amount to between about 0.01 and about 0.1 g/l of cyanamide.

17. The process of etching a copper-clad substrate as defined in claim 3 wherein said etch accelerating additive is the accelerating effective portion of the reaction product of thiourea and a cupric salt in an alkaline medium, said reaction product being present in the bath in an activity equivalent amount to between about 0.01 and about 0.1 g of cyanamide per liter of said bath.

18. The process of etching a copper-clad substrate as defined in claim 3 wherein said etch accelerating additive is cyanamide and thiourea.

19. The process of etching a copper-clad substrate as defined in claim 3 wherein said etch-accelerating additive is formamidine disulfide dihydrochloride.

20. The process of etching a copper-clad substrate as defined in claim 3 wherein the pH of said bath is between about 8 and about 9.

21. A process of etching a copper-clad substrate as defined in claim 3 wherein the temperature of said bath impinging upon said copper substrate is about 120° F.

22. A process of etching a copper-clad substrate as defined in claim 3 wherein said etch rate increase is between about 10 percent and about 40 percent.

23. The aqueous alkaline ammoniacal cupric etching bath according to claim 7 wherein said accelerating effective portion of the reaction product of thiourea and a cupric salt in an alkaline medium is prepared by reacting thiourea with said cupric salt in alkaline media, slurrying the copper-thiourea adduct in a 50 percent NaOH solution, discarding the copper sulfide precipitate, and adjusting the resulting solution to a pH between about 12 and about 14.

24. The bath according to claim 1 wherein said additive is formamidine disulfide dihydrochloride.

25. The bath according to claim 1 wherein said additive is formamidine sulfinic acid.

26. The bath according to claim 1 wherein said additive is 2,5-dithiobiurea.

27. An aqueous alkaline ammoniacal cupric etching bath containing an etch accelerating additive which is selected from the group consisting of thiourea and reaction products of thiourea with cupric salts in an alkaline medium, said etch accelerating additive being present in an amount sufficient to increase the etch rate of said bath by at least about 10 percent over an identical aqueous cupric etching bath free of said additive.

28. A process of etching a copper-clad substrate having a portion of its surface masked with a resistant coating including the step of forcefully contacting both the masked and unmasked portions of said surface with a stream of an aqueous ammoniacal cupric etching solution containing an etch accelerating additive which is selected from the group consisting of thiourea and reaction products of thiourea with cupric salts in an alkaline medium, said etch accelerating additive being present in an amount sufficient to increase the etch rate of said bath by at least about 10 percent over an identical aqueous alkaline cupric etching bath free of said additive and without substantially increasing the amount of undercut over the undercut obtained on a copper-clad substrate with an identical aqueous alkaline cupric etching bath free of said additive.

* * * * *